US010323588B2

(12) United States Patent
VanDerWege

(10) Patent No.: US 10,323,588 B2
(45) Date of Patent: Jun. 18, 2019

(54) METHOD AND SYSTEM FOR PARTICULATE MATTER CONTROL

(71) Applicant: Ford Global Technologies, LLC, Dearborn, MI (US)

(72) Inventor: Brad Alan VanDerWege, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 619 days.

(21) Appl. No.: 14/521,314

(22) Filed: Oct. 22, 2014

(65) Prior Publication Data

US 2016/0115878 A1 Apr. 28, 2016

(51) Int. Cl.

*F02D 41/00* (2006.01)
*F02D 17/02* (2006.01)
*F02D 41/14* (2006.01)

(52) U.S. Cl.

CPC ..... *F02D 41/0087* (2013.01); *F02D 17/02* (2013.01); *F02D 41/1466* (2013.01); *F02D 41/1467* (2013.01); *F02D 2200/021* (2013.01)

(58) Field of Classification Search

CPC ..... F02D 41/0087; F02D 17/02; F02D 17/00; F02D 41/0082; F02D 41/008; F02D 2200/021; F02D 41/1466; F02D 41/1467; F02D 2200/022; Y02T 10/44

USPC ..... 701/103–105, 113; 123/481, 198 F, 299, 123/300, 305, 406.23, 491, 685, 686

See application file for complete search history.

(56) References Cited

U.S. PATENT DOCUMENTS 5,555,871 A * 9/1996 Gopp ..... F02B 75/22 123/198 D
5,813,383 A * 9/1998 Cummings ..... F01L 1/146 123/145 A
6,405,705 B1 6/2002 Dunsworth et al.
7,143,727 B1 * 12/2006 Winstead ..... F01L 9/04 123/198 F
8,402,942 B2 3/2013 Tripathi et al.
8,651,091 B2 * 2/2014 Tripathi ..... F02D 17/02 123/481

(Continued)

FOREIGN PATENT DOCUMENTS

CA 2798599 A1 2/2013

OTHER PUBLICATIONS

He, Xin et al., "Effects of Gasoline Direct Injection Engine Operating Parameters on Particle Number Emissions," Energy & Fuels, American Chemical Society, Mar. 2, 2012, pp. 2014-2027, 14 pages.
Zigler, Brad, "Study Reveals Fuel Injection Timing Impact on Particle Number Emissions," National Renewable Energy Laboratory, Dec. 2012, 1 page.

(Continued)

*Primary Examiner* — David E Hamaoui
*Assistant Examiner* — Carl C Staubach
(74) *Attorney, Agent, or Firm* — Julia Voutyras; McCoy Russell LLP

(57) ABSTRACT

Methods and systems are provided for particulate matter control in an engine configured for skip-fire operation. A cylinder pattern selected for selective cylinder deactivation, including a total number of deactivated/active cylinders as well as individual deactivated cylinder identities, may be adjusted based on an engine soot load, or a parameter indicative of engine soot load such as engine coolant temperature. In addition, reactivated engine cylinders may be transiently operated with split fuel injection to raise combustion surface temperatures.

10 Claims, 6 Drawing Sheets

(56) References Cited

U.S. PATENT DOCUMENTS

| | | | | |
|---|---|---|---|---|
| 9,458,780 | B2 * | 10/2016 | Burleigh | F02D 41/0087 |
| 2006/0169245 | A1 * | 8/2006 | Zillmer | B60K 6/48 123/299 |
| 2007/0068485 | A1 * | 3/2007 | Hilditch | F02D 41/0255 123/299 |
| 2011/0137543 | A1 * | 6/2011 | Gibson | F02D 41/0087 701/113 |
| 2011/0265454 | A1 * | 11/2011 | Smith | F01N 3/0842 60/274 |
| 2015/0051809 | A1 * | 2/2015 | Glugla | F02D 17/02 701/103 |
| 2015/0377171 | A1 * | 12/2015 | Mahadevan | F02D 17/02 123/294 |
| 2016/0108798 | A1 * | 4/2016 | VanDerWege | F02D 41/0087 60/602 |
| 2016/0108825 | A1 * | 4/2016 | Rumpsa | F02D 17/02 123/332 |
| 2016/0108828 | A1 * | 4/2016 | Glugla | F02D 41/0087 123/344 |
| 2016/0108834 | A1 * | 4/2016 | McConville | F02D 41/0087 123/90.15 |
| 2016/0115884 | A1 * | 4/2016 | VanDerWege | F02D 41/0087 123/481 |
| 2016/0186672 | A1 * | 6/2016 | Mehrotra | F01N 3/2006 60/274 |

OTHER PUBLICATIONS

Dobrin, Victor et al., "Intake System Having a Silencer Device", U.S. Appl. No. 14/056,317, filed Oct. 17, 2013, 24 pages.

* cited by examiner

METHOD AND SYSTEM FOR PARTICULATE MATTER CONTROL

FIELD

The present application relates to methods and systems for controlling particulate matter emissions from an engine system configured to perform skip-fire combustion.

BACKGROUND AND SUMMARY

Engines may be configured to operate with a variable number of active or deactivated cylinders to increase fuel economy, while optionally maintaining the overall exhaust mixture air-fuel ratio about stoichiometry. Such engines are known as variable displacement engines (VDE). Therein, a portion of an engine's cylinders may be disabled during selected conditions defined by parameters such as a speed/load window, as well as various other operating conditions including vehicle speed. A VDE control system may disable a selected group of cylinders, such as a bank of cylinders, through the control of a plurality of cylinder valve deactivators that affect the operation of the cylinder's intake and exhaust valves, or through the control of a plurality of selectively deactivatable fuel injectors that affect cylinder fueling.

Further improvements in fuel economy can be achieved in engines configured to vary the effective displacement of the engine by skipping the delivery of fuel to certain cylinders in an indexed cylinder firing pattern, also referred to as a "skip-fire" pattern. One example of a skip-fire engine is shown by Tripathi et al. in U.S. Pat. No. 8,651,091. Therein, an engine fuel controller may continuously rotate which particular cylinders are fueled, which cylinders are skipped, and how many cylinders events the pattern is continued for. By skipping fuel delivery to selected cylinders, the active cylinders can be operated near their optimum efficiency, increasing the overall operating efficiency of the engine. By varying the identity and number of cylinders skipped, a large range of engine displacement options may be possible.

However the inventors herein have identified a potential issue with such engine systems. Specifically, particulate matter (e.g., soot) emissions may be degraded in such engine systems, particularly during cylinder reactivation following skip-firing (or selective cylinder deactivation in a VDE engine). As such, particulate matter (PM) emissions from spark ignited engines tend to increase when the combustion chamber surfaces are cooler. This is because fuel that reaches the cool surface evaporates more slowly, resulting in fuel films surviving on the combustion surface even after the combustion event has occurred. The fuel-rich area above the film, and the fuel evaporating from the film after the flame has passed can lead to soot formation. In addition to cold-start conditions, combustion chamber surface cooling may be accelerated during light load operation, and cylinder deactivation. Consequently, when a cylinder that was shut off for skip-firing is reactivated, there may be a tendency for noticeably higher PM emissions.

In one example, the above issue may be at least partly addressed by a method of operating an engine comprising: deactivating a first cylinder pattern of individual cylinder valve mechanisms at a first engine soot load; and deactivating a second, different, cylinder pattern of individual cylinder valve mechanisms at a second, higher, engine soot load. In this way, the skip-firing pattern of the engine may be adjusted based on the engine's soot load to keep selected engine cylinders, or all engine cylinders warm, thereby reducing exhaust PM emissions. In addition, when the cylinders are reactivated, fueling of the reactivated cylinders may be adjusted to further reduce PM emissions due to cold cylinder piston conditions.

For example, during conditions when engine coolant temperature is lower than a threshold (or soot load is higher than a threshold), and the propensity for soot production at cold cylinder combustion chamber surfaces is high, in response to a drop in torque demand, a cylinder pattern of individual cylinder valve mechanisms may be adjusted so that the periodic firing is distributed across all engine cylinders. Specifically, the cylinder pattern may be selected based on the engine configuration and cylinder firing order so that the temperature of each engine cylinder is maintained above a threshold. As such, this reduces cylinder cooling during the period of cylinder deactivation. During a subsequent reactivation of engine cylinders, such as in response to a rise in torque demand, if the engine coolant temperature is still lower than the threshold, or the engine soot load is higher than the threshold, the reactivated cylinders may be operated with split fuel injection and retarded fuel delivery for a duration to reduce soot emissions from the reactivated cylinders. This may include fueling as multiple intake stroke injections and/or a combination of intake and compression stroke injections. At the same time, the remaining active engine cylinders may continue to be operated with single fuel injection at nominal injection timing. The number of injections per engine cycle in the split fuel injection, the amount of injection timing retard, as well as the number of engine cycles over which the split fuel injection is continued for each reactivated cylinder may be adjusted based on the cylinder pattern applied as well as the number of combustion events skipped in each reactivated cylinder during the preceding deactivation. In doing so, each cylinder's temperature may be brought above a level that generates soot emissions during the reactivation.

In this way, by adjusting the pattern of cylinder deactivation response to engine soot load and engine coolant temperature, a combustion surface temperature of cylinders may be better controlled during the cylinder deactivation. By maintaining cylinders sufficiently warm during the cylinder deactivation, the likelihood of high PM emissions from the cylinders upon subsequent reactivation is reduced. In addition, the number of times that cool cylinders have to reactivated is reduced, extending cylinder deactivation benefits. By further operating reactivated cylinders with split fuel injection for a number of combustion events during a reactivation, further improvements in PM emissions is achieved while also improving the restart combustion stability of the reactivated cylinders. By injecting the fuel as multiple intake stroke injections (or an intake stroke and an early compression stroke injection), and by retarding the start of injection timing, the momentum of the fuel spray is reduced, decreasing the likelihood of the fuel spray wetting the combustion surface. In addition, cylinder heating following the cylinder deactivation can be expedited, providing emissions benefits. Overall, engine performance is improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
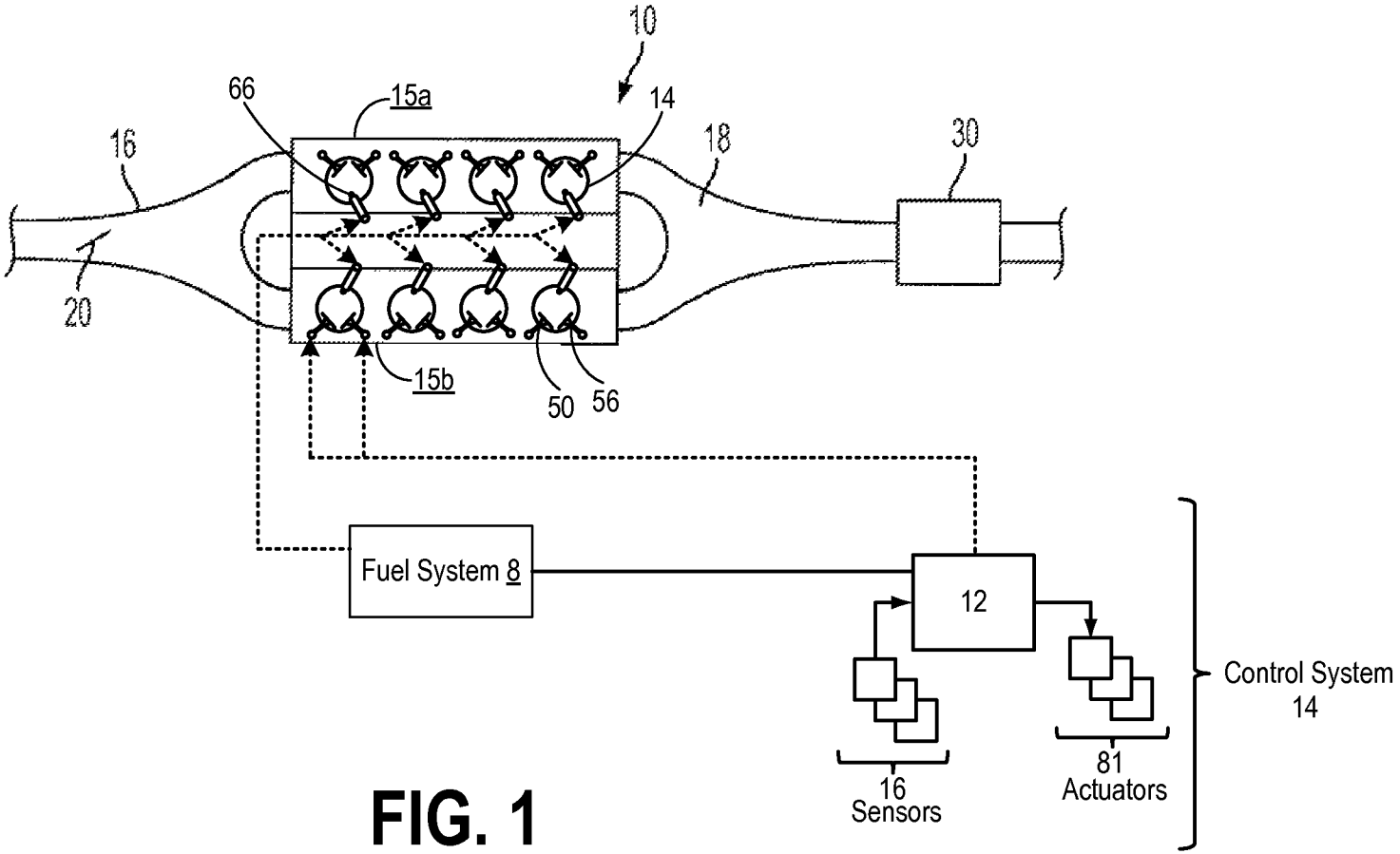
FIG. 1 shows an example embodiment of an engine system layout.
Figure 2:
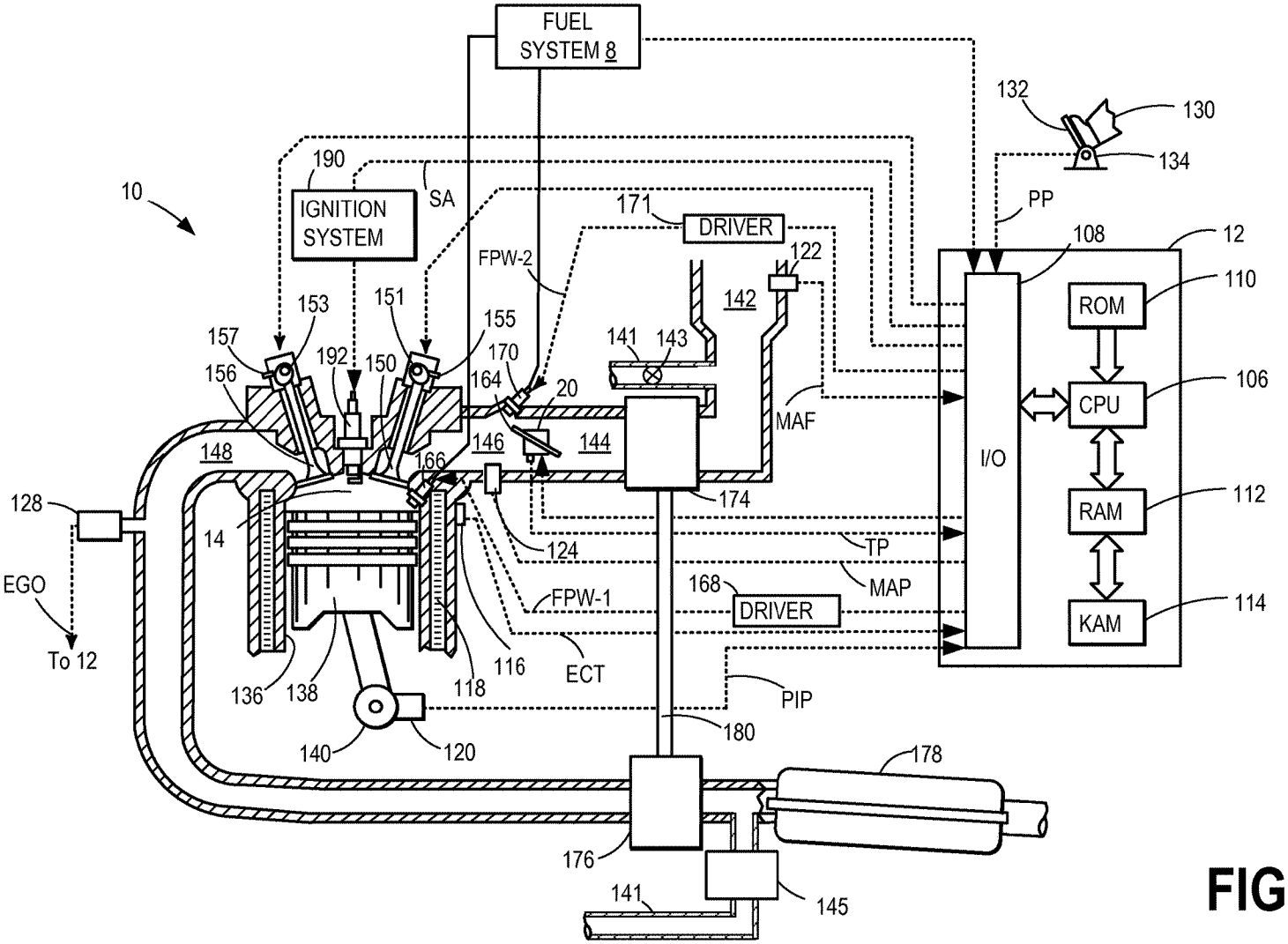
FIG. 2 shows a partial engine view.
Figure 3:
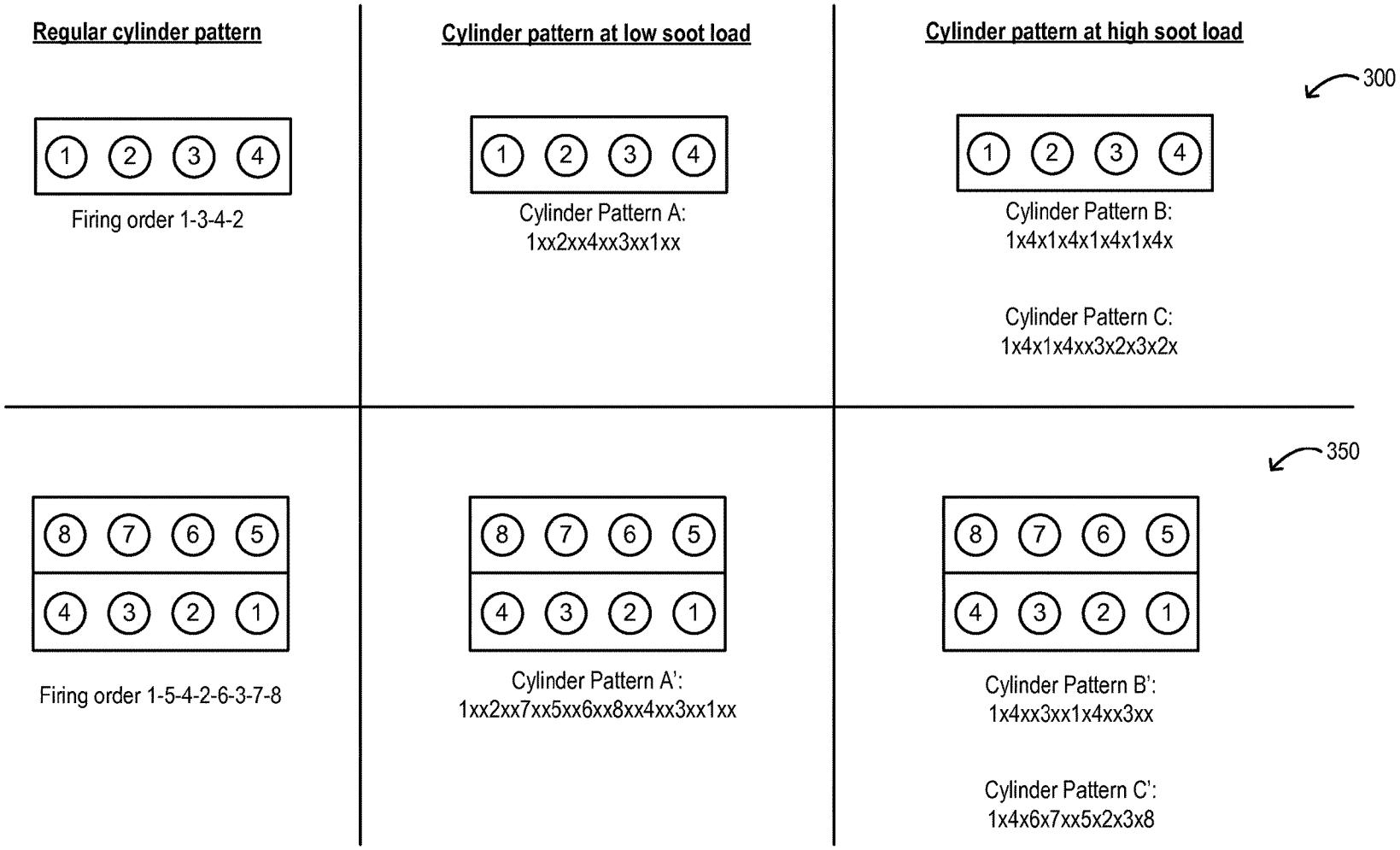
FIG. 3 shows example cylinder deactivation patterns in an in-line 4 cylinder engine and a V8 engine.

Methods and systems are provided for adjusting a fuel injection profile when operating an engine configured for selective cylinder deactivation (herein also referred to as skip-fire operation), such as the engine system of FIGS. 1-2. A controller may adjust the skip-firing pattern selected responsive to cylinder deactivation conditions based on engine coolant temperature to reduce a soot load of the engine. Example cylinder deactivation patterns that may be applied in different engine configurations are shown at FIG. 3. A controller may be configured to perform a routine, such as the routine of FIG. 4, to select a cylinder deactivation pattern based on the soot load of the engine to maintain the engine warm during the deactivation and reduce the frequency of cool cylinder reactivation. The controller may be further configured to transiently shift cylinders being reactivated to late split fuel injection to further improve cylinder warming. In this way, particulate matter emissions when transitioning out of a skip-fire mode of operation, can be reduced.

FIG. 1 shows an example engine 10 having a first bank 15*a* and a second bank 15*b*. In the depicted example, engine 10 is a V8 engine with the first and second banks each having four cylinders. Engine 10 has an intake manifold 16, with throttle 20, and an exhaust manifold 18 coupled to an emission control system 30. Emission control system 30 includes one or more catalysts and air-fuel ratio sensors, such as described with regard to FIG. 2. As one non-limiting example, engine 10 can be included as part of a propulsion system for a passenger vehicle.

Engine system 10 may have cylinders 14 with selectively deactivatable intake valves 50 and selectively deactivatable exhaust valves 56. In one example, intake valves 50 and exhaust valves 56 are configured for electric valve actuation (EVA) via electric individual cylinder valve actuators. While the depicted example shows each cylinder having a single intake valve and a single exhaust valve, in alternate examples, as elaborated at FIG. 2, each cylinder may have a plurality of selectively deactivatable intake valves and/or a plurality of selectively deactivatable exhaust valves.

During selected conditions, such as when the full torque capability of the engine is not needed, one or more cylinders of engine 10 may be selected for selective deactivation (herein also referred to as individual cylinder deactivation). This may include selectively deactivating one or more cylinders on only the first bank 15*a*, one or more cylinders on only the second bank 15*b*, or one or more cylinders on each of the first and second bank. The number and identity of cylinders deactivated on each bank may be symmetrical or asymmetrical.

During the deactivation, selected cylinders may be deactivated by closing the individual cylinder valve mechanisms, such as intake valve mechanisms, exhaust valve mechanisms, or a combination of both. Cylinder valves may be selectively deactivated via hydraulically actuated lifters (e.g., lifters coupled to valve pushrods), via a cam profile switching mechanism in which a cam lobe with no lift is used for deactivated valves, or via the electrically actuated cylinder valve mechanisms coupled to each cylinder. In addition, fuel flow and spark to the deactivated cylinders may be stopped, such as by deactivating cylinder fuel injectors.

In some examples, engine system 10 may have selectively deactivatable (direct) fuel injectors and the selected cylinders may be deactivated by shutting off the respective fuel injectors while maintaining operation of the intake and exhaust valves such that air may continue to be pumped through the cylinders.

While the selected cylinders are disabled, the remaining enabled or active cylinders continue to carry out combustion with fuel injectors and cylinder valve mechanisms active and operating. To meet the torque requirements, the engine produces the same amount of torque on the active cylinders. This requires higher manifold pressures, resulting in lowered pumping losses and increased engine efficiency. Also, the lower effective surface area (from only the enabled cylinders) exposed to combustion reduces engine heat losses, improving the thermal efficiency of the engine.

Cylinders may be deactivated to provide a specific firing (or skip-firing) pattern based on a designated control algorithm. More specifically, selected "skipped" working cycles are not fired while other "active" working cycles are fired. Optionally, a spark timing associated with a selected firing of a selected working chamber may also be adjusted based on a firing order or firing history of the selected working chamber. The engine controller 12 may be configured with suitable logic, as described below, for determining a cylinder deactivation (or skip-firing) pattern based on engine operating conditions.

Engine 10 may operate on a plurality of substances, which may be delivered via fuel system 8. Engine 10 may be controlled at least partially by a control system including controller 12. Controller 12 may receive various signals from sensors 16 coupled to engine 10 (and described with reference to FIG. 2), and send control signals to various actuators 81 coupled to the engine and/or vehicle (as described with reference to FIG. 2). The various sensors may include, for example, various temperature, pressure, and air-fuel ratio sensors. In addition, controller 12 may receive an indication of cylinder knock or pre-ignition from one or more knock sensors distributed along the engine block. When included, the plurality of knock sensors may be distributed symmetrically or asymmetrically along the engine block. Further, the one or more knock sensors may include accelerometers, ionization sensors or in cylinder pressure transducers.

Engine controller may include a drive pulse generator and a sequencer for determining a cylinder pattern based on the desired engine output at the current engine operating conditions. For example, the drive pulse generator may use adaptive predictive control to dynamically calculate a drive pulse signal that indicates which cylinders are to be fired and at what intervals to obtain the desired output (that is, the cylinder firing/skip-firing pattern). The cylinder firing pattern may be adjusted to provide the desired output without generating excessive or inappropriate vibration within the engine. As such, the cylinder pattern may be selected based on the configuration of the engine, such as based on whether the engine is a V-engine, an in-line engine, the number of engine cylinders present in the engine, etc. Based on the selected cylinder pattern, the individual cylinder valve mechanisms of the selected cylinders may be closed while fuel flow and spark to the cylinders are stopped.

Since optimal efficiency for a given cylinder is near full output, a lower frequency of firing events may be chosen to reduce output. For example, skipping every other cylinder would produce half of the power, on average. Spacing the firing events out as evenly as possible tends to minimize vibrations due to the varying torque output. Whether all of the cylinders are included in the skip-firing pattern may depend on the fraction of output desired, and other considerations including cylinder temperature.

In this way, by adjusting the cylinder pattern of individual cylinder valve mechanisms and individual cylinder fuel injectors, a desired engine output can be provided by operating fewer cylinders more efficiently, thereby improving fuel economy.

Figure 4:
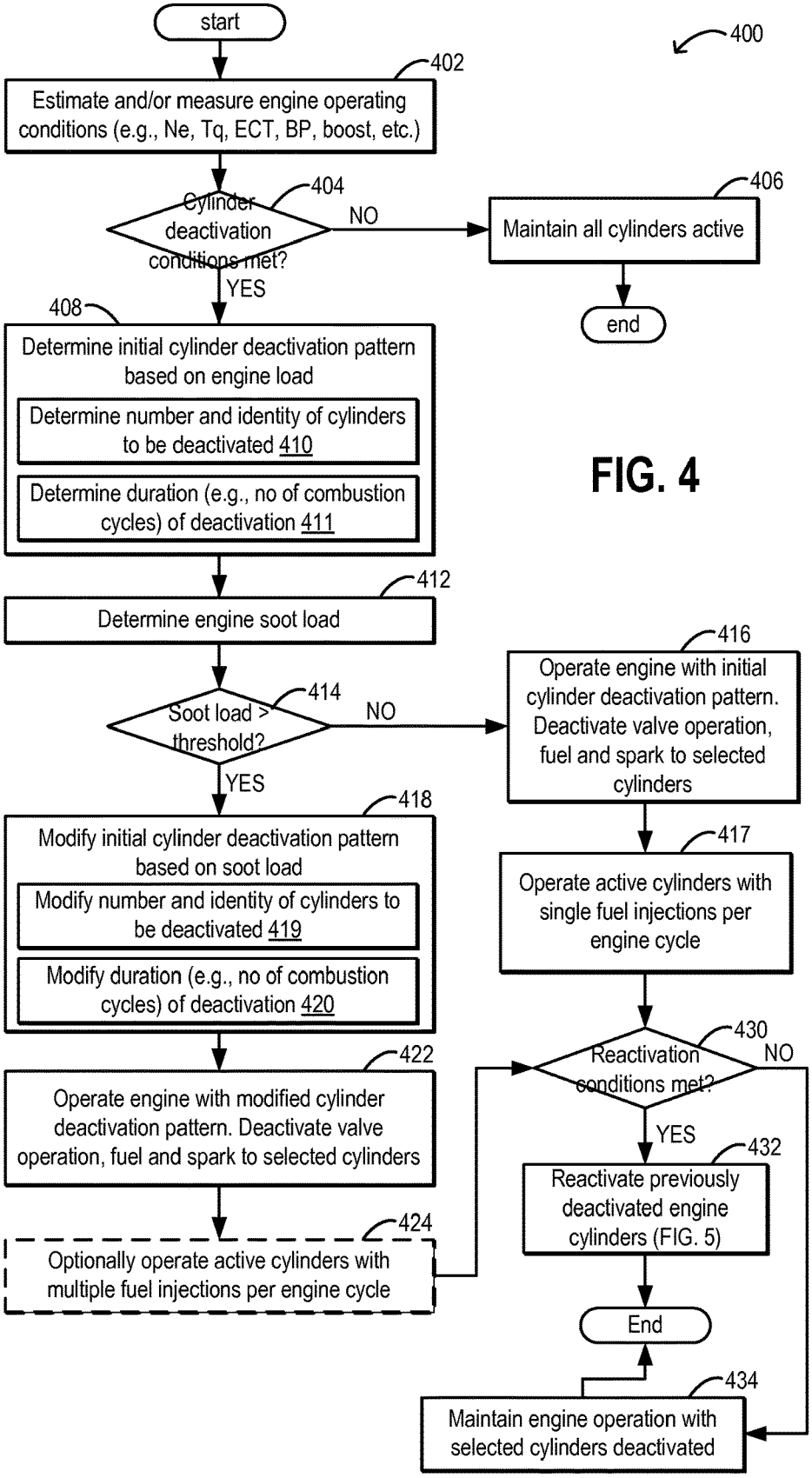
FIG. 4 shows a high level flow chart for adjusting a fueling pattern of an engine configured for selective individual cylinder deactivation responsive to soot load.

As elaborated herein with reference to FIG. 3-4, the controller may further adjust the cylinder pattern based on emissions constraints, such as particulate matter emission (PM) limits. Specifically, to reduce PM emissions resulting from cold cylinder combustion surface conditions, a cylinder pattern may be selected that keeps cylinders warm. The soot load based pattern may be selected during specific conditions such as an engine cold-start when the exhaust catalyst is below the light-off temperature, or conditions when engine coolant temperature is below a threshold. Alternatively, the soot load based pattern may be performed during conditions when the engine soot load is above a threshold. The controller may select a pattern where firing is distributed across all cylinders so that none of the cylinders gets too cool. Alternatively, a pattern may be selected where firing is concentrated on a specific set of cylinders to keep them warm. Additionally, fuel injection to the active cylinders may be adjusted, such as by using split fuel injection and/or retarded injection to further reduce soot emissions. By maintaining the temperature of the cylinders, the duration of operation with selective cylinder deactivation can be increased, prolonging cylinder deactivation benefits. In addition, the frequency of cylinder reactivation to warm the cylinders is reduced.

FIG. 2 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 2 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 1, or alternatively may be provided upstream of compressor 174.

Exhaust passage 148 may receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be measured by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, Cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 13:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes.

In some embodiments, each cylinder of engine 10 may be configured with one or more injectors for delivering fuel to the cylinder. As a non-limiting example, cylinder 14 is shown including two fuel injectors 166 and 170. Fuel injectors 166 and 170 may be configured to deliver fuel received from fuel system 8 via a high pressure fuel pump, and a fuel rail. Alternatively, fuel may be delivered by a single stage fuel pump at lower pressure, in which case the timing of the direct fuel injection may be more limited during the compression stroke than if a high pressure fuel system is used. Further, the fuel tank may have a pressure transducer providing a signal to controller 12.

Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 166 and 170, different effects may be achieved.

Fuel may be delivered by both injectors to the cylinder during a single cycle of the cylinder. For example, each injector may deliver a portion of a total fuel injection that is combusted in cylinder 14. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 2 shows only one cylinder of a multi-cylinder engine. As such each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 2 with reference to cylinder 14.

The engine may further include one or more exhaust gas recirculation passages for recirculating a portion of exhaust gas from the engine exhaust to the engine intake. As such, by recirculating some exhaust gas, an engine dilution may be affected which may improve engine performance by reducing engine knock, peak cylinder combustion temperatures and pressures, throttling losses, and NOx emissions. In the depicted embodiment, exhaust gas may be recirculated from exhaust passage 148 to intake passage 144 via EGR passage 141. The amount of EGR provided to intake passage 148 may be varied by controller 12 via EGR valve 143. Further, an EGR sensor 145 may be arranged within the EGR passage and may provide an indication of one or more pressure, temperature, and concentration of the exhaust gas.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and manifold absolute pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system.

Storage medium read-only memory 110 can be programmed with computer readable data representing instructions executable by processor 106 for performing the methods described below as well as other variants that are anticipated but not specifically listed.

FIG. 3 shows example cylinder patterns that may be used for an in-line 4 cylinder engine during selected conditions at map 300, and cylinder patterns that may be used for a V8 engine at map 350. Map 300 compares a regular cylinder firing pattern for the in-line 4 cylinder engine to example cylinder patterns that may be applied at low soot load conditions (cylinder pattern A) or high soot load conditions (cylinder patterns B and C). Likewise, map 350 compares a regular cylinder firing pattern for the V8 engine to example cylinder patterns that may be applied at low soot load conditions (cylinder pattern A') or high soot load conditions (cylinder patterns B' and C').

With reference to map 300, the in-line 4 cylinder engine with cylinders labeled 1 through 4 as shown has a firing pattern of 1-3-4-2. Thus, during regular operating conditions, when no cylinder is deactivated and all cylinders are active, the cylinders may be firing as 134213421342 and so on.

In response to cylinder deactivation conditions being met, to provide fuel economy benefits, the controller may shift engine operation to Cylinder pattern A where every third cylinder is fired resulting in the pattern 1xx2xx4xx3xx1xx, and wherein x represents a skipped cylinder. In this pattern, all of the cylinders are fired infrequently and therefore may be relatively cool, especially shortly after a cold-start. Such a pattern may be selected during conditions when PM emissions are not limiting, such as at low soot load conditions. As used herein, low soot load conditions indicate conditions when PM production or PM concentration is below a threshold. Cylinder pattern A may alternatively be applied during conditions when engine coolant temperature is sufficiently warm, such as above a threshold temperature. During warm engine coolant conditions, soot production from cool cylinder surfaces may not be excessive.

In comparison, when cylinder deactivation conditions are met, and while PM emissions are limiting, such as at high soot load conditions, to provide fuel economy benefits, the controller may shift engine operation to one of cylinder pattern B or C. In cylinder pattern B, selected cylinders are fired every other cycle. In the depicted example, cylinders 1 and 4 are fired every other cycle resulting in the pattern 1x4x1x4x1x4x1x4x. This pattern would result in the active cylinders 1 and 4 being warmed up faster and being maintained warm longer. As a result, the need to reactivate cylinders 2 and 3 may be reduced. It would also reduce the load (torque) required from each combustion since they fire at a higher frequency. However, such a pattern that concentrates on select cylinders frequently may have lower fuel economy benefits. In addition, when the required engine torque increases and cylinders 2 and 3 are required, they may be much cooler, causing a higher level of PM emissions from cylinders 2 and 3, and potentially requiring more fuel usage for getting cylinders 2 and 3 warmed. In one example, cylinder pattern B may be selected when the engine is cool but when the increases in torque are less frequent, such as during cruise control conditions. As such, pattern B provides a substantially ⅓ firing frequency that allows a subset of cylinders to be fired repeatedly for rapid heating.

In cylinder pattern C, the firing pattern is adjusted so that instead of firing alternating cycles on the same cylinders for an extended period of time (as in pattern B), the pattern periodically switches to other cylinders. This approach ensures that any given cylinders is not allowed to cool off too much, thereby maintaining all cylinders warm. Essentially, cylinder temperatures are evened-out. In the depicted example, cylinders 1-4 are fired periodically resulting in the pattern 1x4x1x4xx3x2x3x2. As such, pattern C provides a substantially ½ firing frequency that maintains an even temperature across the cylinders. This pattern would result in all the cylinders being active at different points of the drive cycle, thereby maintaining all cylinders warm longer. Consequently, the need to reactivate the cylinders for warm-up is reduced. In addition, when the required engine torque increases and the 1-3-4-2 firing pattern is resumed, all cylinders may be warmer, causing a lower level of PM emissions from the engine cylinders. In one example, cylinder pattern C may be selected when the engine is cool but when the increases in torque are more frequent, or during conditions when restarting cylinders that have been off for a while creates too much PM burden. In an alternate example, if a ⅓ firing frequency is desired while maintaining even cylinder temperatures, the controller may revert to Pattern A.

With reference to map 350, the V8 engine with cylinders arranged on two banks, the cylinders labeled 1 through 8 as shown have a firing pattern of 1-5-4-2-6-3-7-8. Thus, during regular operating conditions, when no cylinder is deactivated and all cylinders are active, the cylinders may be firing as 1542637815426378 and so on.

In response to cylinder deactivation conditions being met, to provide fuel economy benefits, the controller may shift engine operation to Cylinder pattern A' where every 3rd cylinder is fired resulting in the pattern 1xx2xx7xx5xx6xx8xx4xx3xx1xx2 . . . , and wherein x represents a skipped cylinder. In this pattern, all of the cylinders are fired infrequently and therefore may be relatively cool, especially shortly after a cold-start. Such a pattern may be selected during conditions when PM emissions are not limiting, such as at low soot load conditions. Cylinder pattern A' may alternatively be applied during conditions when engine coolant temperature is sufficiently warm, such as above a threshold temperature. During warm engine coolant conditions, soot production from cool cylinder surfaces may not be excessive.

In comparison, when cylinder deactivation conditions are met, and while PM emissions are limiting, such as at high soot load conditions, to provide fuel economy benefits, the controller may shift engine operation to one of cylinder pattern B' or C'. In cylinder pattern B', only selected cylinders are fired every cycle. In the depicted example, the desired ⅓ frequency is rounded up to ⅜, so that cylinders 1, 3, and 4 are fired every cycle, resulting in the pattern 1x4xx3xx1x4xx3xx. This pattern would result in the active cylinders being warmed up faster and being maintained warm longer. However, such a pattern that concentrates on select cylinders frequently may have lower fuel economy benefits. In addition, when the required engine torque increases and cylinders 2, 5, 6, 7, and 8 are required, they may be much cooler, causing a higher level of PM emissions from cylinders 2, 5, 6, 7, and 8, and potentially requiring more fuel usage for getting cylinders 2, 5, 6, 7, and 8 warmed. In one example, cylinder pattern B' may be selected when the engine is cool but when the increases in torque are less frequent, such as during cruise control conditions.

In cylinder pattern C', the firing pattern is adjusted so that instead of firing alternating cycles on the same cylinders for an extended period of time (as in pattern B'), the pattern periodically switches to other cylinders. This approach ensures that any given cylinders is not allowed to cool off too much, thereby maintaining all cylinders warm. Essentially, cylinder temperatures are evened-out. In the depicted example, cylinders 1-8 are fired periodically resulting in the pattern 1x4x6x7xx5x2x3x8. This pattern would maintain all cylinders warm longer. Consequently, the need to reactivate the cylinders for warm-up is reduced. In addition, when the required engine torque increases and the 15426378 firing pattern is resumed, all cylinders may be warmer, causing a lower level of PM emissions from the engine cylinders. In one example, cylinder pattern C' may be selected when the engine is cool but when the increases in torque are more frequent, or during conditions when restarting cylinders that have been off for a while creates too much PM burden.

Now turning to FIG. 4, an example routine 400 is shown for selecting a cylinder pattern for individual cylinder valve mechanisms responsive to engine operating conditions including a soot load of the engine. By modifying the selected pattern during conditions when PM emissions are likely to be higher, engine emissions may be improved. By also maintaining active engine cylinders warm, the number of times cool cylinders are reactivated is reduced, improving cylinder deactivation benefits.

At 402, the routine includes estimating and/or measuring engine operating conditions. These may include, for example, engine speed, desired torque (for example, from a pedal-position sensor), manifold pressure (MAP), manifold air flow (MAF), barometric pressure (BP), boost pressure, engine temperature, catalyst temperature, intake temperature, spark timing, air temperature, knock limits, etc.

At 404, based on the estimated conditions, it may be determined if cylinder deactivation conditions have been met. In one example, cylinder deactivation conditions may be considered met if the driver demand is less than a threshold. Further, cylinder deactivation may be enabled only if engine coolant temperature is above a threshold to preempt cold cylinder conditions related issues. As such, the combined effect of cold engine coolant and the lack of combustion in a particular cylinder during cylinder deactivation may result in very cool cylinder combustion surfaces which may be more prone to soot generation. If cylinder deactivation conditions are not met, at 406, the routine continues engine operation with all cylinders active.

If cylinder deactivation conditions are met, at 408, the routine includes determining an initial cylinder deactivation pattern (or cylinder pattern for individual cylinder valve mechanisms) based on current engine operating conditions including driver demand and engine load. The initial cylinder deactivation pattern may be further based on one or more of engine speed, vehicle speed, engine temperature, engine NVH, and a transmission gear selection (e.g., whether the engine is currently in a first transmission gear with a first, lower gear ratio or a second transmission gear with a second, higher gear ratio). Determining the cylinder pattern includes determining the number and identity of cylinders to be deactivated at 410, and further determining a duration of the deactivation at 411. For example, the controller may determine a number of combustion events or engine cycles over which to maintain the selected cylinders deactivated. The total number of deactivated/active cylinders may depend on the total actual number of engine cylinders and the driver demand torque. As a non-limiting example, two cylinders may be deactivated for a four cylinder engine, three cylinders may be deactivated for a six cylinder engine, and four cylinders may be deactivated for an eight cylinder engine. As also elaborated with reference to FIG. 3, in some examples, the same set of cylinders may be selected for deactivation each time cylinder deactivation conditions are met, while in other examples, the identity of the deactivated cylinders may be varied each time cylinder deactivation conditions are met.

In engine systems where cylinders include individual cylinder valve mechanisms coupled to each of a plurality of intake and exhaust valves, the controller may further determine whether to close one or more intake valve mechanisms, one or more exhaust valve mechanisms, or a combination of both during the cylinder deactivation when fuel and spark to the cylinder is ceased. Further, the controller may determine a relative timing of intake and exhaust valve closure for each cylinder selected for deactivation.

In some embodiments, in response to the cylinder deactivation conditions being met at 404, the controller may also reset counters for each cylinder that is deactivated at 408. Two counters may be provided for each cylinder that may be deactivated. A first counter for a cylinder may count a number of engine or cylinder cycles that an individual cylinder is deactivated (e.g., intake and exhaust valves are closed over at least an entire engine cycle (two revolutions for a four cycle engine), fuel flow is stopped to the cylinder, and spark is not provided to the cylinder) after the cylinder has been active (e.g., combusting air and fuel) for at least one cylinder cycle. A second counter for the cylinder may count a number of combustion events in the cylinder after the cylinder has been reactivated from a deactivated state. At 404, the first counters of each cylinder that may be deactivated are reset to a value of zero so that an accurate count of engine or cylinder cycles since the cylinder was deactivated may be determined. Method 400 may then proceed to 412 after the counters of each cylinder to be deactivated have been reset to zero.

At 412, the routine includes estimating an engine soot load. The soot load refers to the rate of production of PM emissions, or PM concentration. In one example, the engine soot load may be estimated based on the output of a PM sensor coupled to the engine exhaust passage. Alternatively, the engine soot load may be estimated based on engine operating conditions, such as an engine coolant temperature. For example, during conditions when engine coolant temperature is lower, such as soon after a cold-start, the likelihood of PM emissions from the engine is higher.

At 414, the estimated soot load may be compared to a threshold to determine if the soot load is higher than a threshold. It will be appreciated that the engine soot load may include a current soot load and/or a predicted soot load based on current operating conditions. Thus, it may be determined if the current soot load is already higher than a threshold, or if engine operating conditions predict the propensity for high PM emissions. In alternate examples, such as where the engine soot load is inferred based on engine coolant temperature, it may be determined if the coolant temperature is below a threshold temperature. Further, the routine may look a parameter other than engine coolant temperature that is indicative of engine soot load.

If the soot load is below the threshold (or if the engine coolant temperature is above the threshold temperature), at 416, the routine includes operating with the initial cylinder deactivation pattern determined at 408. Accordingly, also at 416, the selected cylinders are deactivated by holding closed the intake and exhaust valves of the cylinders over at least an entire engine cycle (e.g., two engine crankshaft revolutions). Further, fuel flow and spark supplied to the cylinders being deactivated are ceased while the engine continues to the rotate and while valve, fuel, and spark operation of the active cylinders is maintained. At 417, the remaining active cylinders may be operated with single fuel injections per engine cycle.

Additionally, the controller may increment count values of the first counters of cylinders that are deactivated. As elaborated above, the first counters may keep track of a number of cylinder cycles or engine cycles that occur while a cylinder is deactivated. Each time a deactivated cylinder completes a cycle, four piston strokes, or one engine cycle a count value held in the deactivated cylinder's first counter is incremented. Count values of other deactivated cylinders are incremented similarly. By counting the actual total number of engine cycles or cylinder cycles a cylinder is deactivated, it may be possible to determine a start of fuel injection time and a number of fuel injections to provide to the present deactivated cylinder upon reactivation. The number of engine or cylinder cycles since deactivating the cylinder may be useful in predicting cylinder contents and temperatures in the cylinder when the cylinder is subsequently reactivated. For example, the number of cylinder events after the cylinder is deactivated may be indicative of an amount of exhaust that may be trapped in the cylinder since when the cylinder was deactivated because a small amount of trapped cylinder exhaust or air may be lost each time a piston compresses cylinder gases. Based on the predicted cylinder cooling, fuel injection can be adjusted to compensate for the possibility of PM emissions, as discussed with reference to the reactivation routine of FIG. 5.

Returning to 414, if the soot load is higher than the threshold (or if the engine coolant temperature is below the threshold temperature), at 418, the routine includes modifying the initial cylinder deactivation pattern determined at 408. In lieu of modifying the initial cylinder deactivation pattern, the controller may select an alternate cylinder deactivation pattern. Modifying the initial cylinder deactivation pattern or selecting an alternate cylinder deactivation pattern may include modifying the number and/or identity of cylinders to be deactivated at 419, and/or modifying a duration of the deactivation at 420. For example, the controller may maintain the selected cylinders deactivated over a shorter duration in response to the high soot load to reduce the likelihood of PM emissions from cooled cylinders. As another example, the total number of deactivated/active cylinders may be decreased.

Further still, as illustrated with reference to the cylinder patterns of FIG. 3, the total number of deactivated/active cylinders and duration of cylinder deactivation may be maintained while the identity of deactivated cylinders and the resulting pattern of firing is changed. For example, a cylinder pattern may be selected that fires the same cylinders on alternate cycles for an extended period of time (such as Cylinder patterns B and B'). Alternatively, a cylinder pattern may be selected that periodically switches firing to different cylinders to even out firing frequency between cylinders (such as Cylinder patterns C and C').

At 422, the routine includes operating with the modified cylinder deactivation pattern determined at 418. Accordingly, also at 422, the selected cylinders are deactivated by holding closed the intake and exhaust valves of the cylinders over at least an entire engine cycle (e.g., two engine crankshaft revolutions). Further, fuel flow and spark supplied to the cylinders being deactivated are ceased while the engine continues to the rotate and while valve, fuel, and spark operation of the active cylinders is maintained. Optionally, at 424, while operating with the modified cylinder pattern, the active cylinders may be operated with multiple fuel injections per engine cycle. By shifting the active cylinders to split fuel injection at the higher soot load condition, PM emissions may be reduced. The number of fuel injections per engine cycle in the active cylinders may be adjusted based on the expected cylinder temperature. For example, split fuel injection with a larger number of injections per cycle may be used at lower engine/cylinder temperatures. Further, in addition to operating the active cylinders with split fuel injection, an injection timing may be retarded.

As discussed with reference to step 416, the controller may increment count values of the first counters of cylinders that are deactivated in the modified cylinder pattern. Each time a deactivated cylinder completes a cycle, four piston strokes, or one engine cycle a count value held in the deactivated cylinder's first counter is incremented. Count values of other deactivated cylinders are incremented similarly. By counting the actual total number of engine cycles or cylinder cycles a cylinder is deactivated, cylinder cooling parameters may be predicted. During a subsequent cylinder reactivation routine (FIG. 5), based on the predicted cylinder cooling, fuel injection can be adjusted to compensate for the possibility of PM emissions.

From each of 417 and 424, the routine proceeds to 430 where it is determined if cylinder reactivation conditions have been met. In one example, cylinder reactivation conditions may be considered met in response to an increase in driver torque demand. If reactivation conditions are not met, the routine proceeds to 434 where engine operation with the selected cylinders deactivated is maintained. Else, if reactivation conditions are met, the routine proceeds to 432 to reactivate the previously deactivated cylinders, as elaborated at the method of FIG. 5. In response to the indication of cylinder reactivation, incrementing of the first counters coupled to the deactivated cylinders may be halted, however, the counters may not be reset until a subsequent deactivation routine is triggered.

In this way, by selecting a cylinder pattern with a total number of deactivated/active cylinders and firing order adjusted based on a soot load of the engine, the fuel economy benefits of cylinder deactivation can be extended without degrading engine PM emissions when the cylinders are subsequently reactivated.

In this way, a method for an engine comprises deactivating a first cylinder pattern of individual cylinder valve mechanisms at a first engine soot load; and deactivating a second, different, cylinder pattern of individual cylinder valve mechanisms at a second, higher, engine soot load. Deactivating a first cylinder pattern of individual cylinder valve mechanisms includes deactivating a first number of intake and exhaust valves while deactivating a second cylinder pattern of individual cylinder valve mechanisms includes deactivating a second, different number of intake and exhaust valves. Each of the first and second cylinder patterns are further based on one or more of driver demand, engine speed, vehicle speed, engine temperature, engine NVH, and transmission gear selection. The first cylinder pattern may include a first total number of deactivated/active cylinders while the second cylinder pattern includes a second, different total number of deactivated/active cylinders, the second number larger/smaller than the first number. Specifically, the first cylinder pattern may include a first set of cylinders and the second cylinder pattern includes a second, different set of cylinders, each of the first and second cylinder pattern including a common total number of cylinders. Alternatively, the first and second patterns may have distinct total number of cylinders. Each of the first set of cylinders and the second set of cylinders may be selected based on a cylinder firing order. Further, the controller may perform multiple fuel injections per engine cycle in active cylinders at the second engine soot load with the second cylinder pattern, while performing single fuel injection per engine cycle at the first soot load with the first cylinder pattern. A total number of injections in the multiple fuel injections per cycle may be based on the second cylinder pattern, the total number of injections in active cylinders increased as a total number of cylinders deactivated in the second cylinder pattern increases. The multiple fuel injections may include multiple intake stroke injections, multiple compression stroke injections, or combinations of intake and compression stroke injections.

Figure 5:
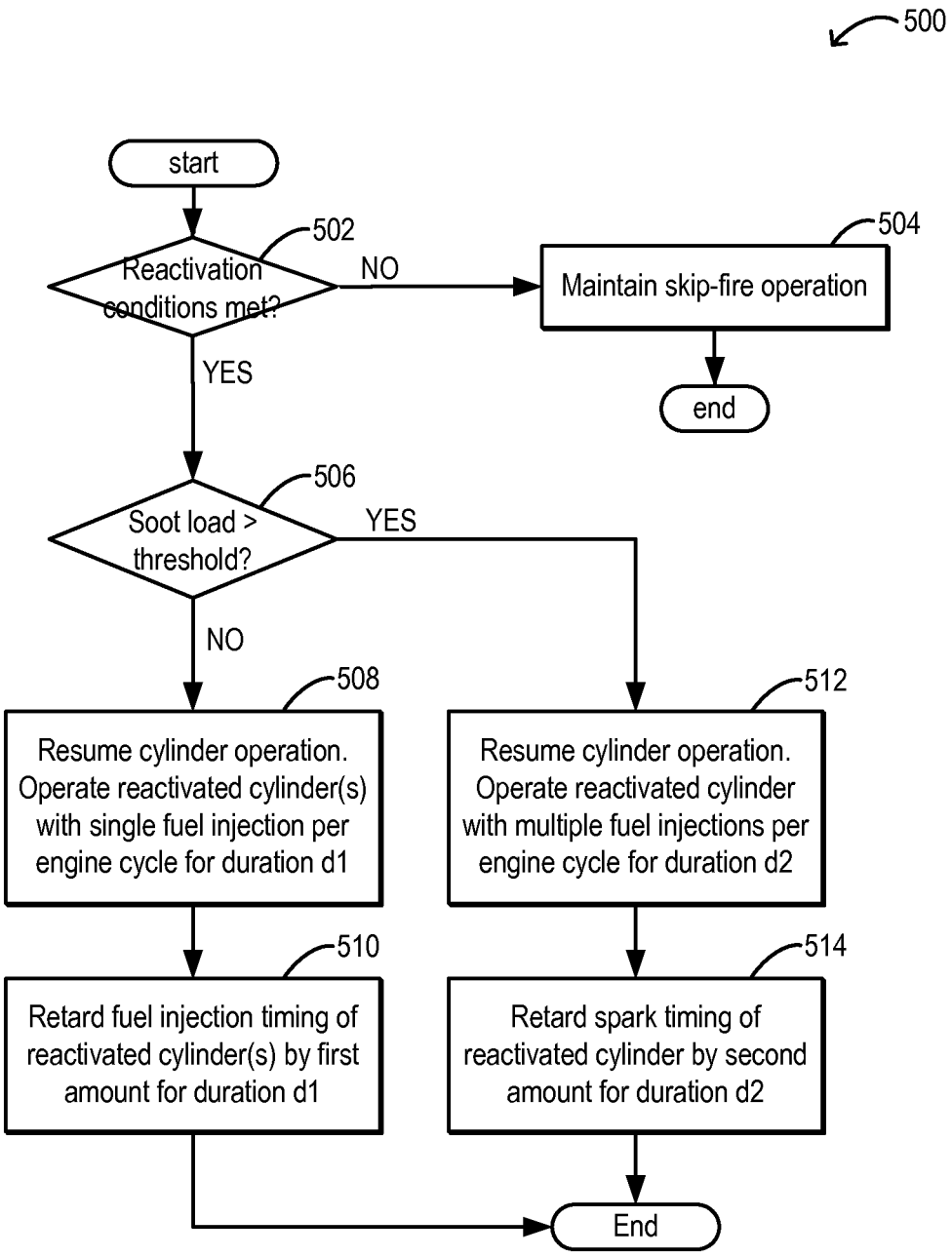
FIG. 5 shows a high level flow chart for adjusting fuel injection reactivated engine cylinder following individual cylinder deactivation responsive to soot load.

As elaborated with reference to FIG. 5, the method may further comprise performing single fuel injection in reactivated cylinders at the first engine soot load with the first cylinder pattern, and performing multiple fuel injections per engine cycle at the second soot load with the second cylinder pattern. A number of injections in the multiple fuel injections per cycle may be based on the second cylinder pattern and a duration of the deactivating the second cylinder pattern. In particular, the number of injections in reactivated cylinders may be increased as a number of cylinders deactivated in the second cylinder pattern increases and/or as the duration of the deactivating the second cylinder pattern increases, the number of injections in reactivated cylinders then decreased as a number of combustion events since the reactivation increases. The multiple fuel injections performed in the reactivated cylinders may include multiple intake stroke injections, multiple compression stroke injections, or combinations of intake and compression stroke injections. For example, the multiple injections may include at least one intake stroke injection and one compression stroke injection. The controller may further retard start of fuel injection timing by a first, smaller amount while performing single fuel injection in reactivated cylinders at the first engine soot load and retard start of fuel injection timing by a second, larger amount while performing multiple fuel injections in reactivated cylinders at the second engine soot load.

Now turning to FIG. 5, an example routine 500 is shown for adjusting cylinder fueling during reactivation of deactivated cylinders. The routine allows fueling to be adjusted to compensate for cylinder cooling during the deactivation, thereby reducing cylinder PM emissions.

At 502, cylinder reactivation conditions may be confirmed. In one example, cylinder reactivation conditions may be considered met in response to an increase in driver torque demand. If reactivation conditions are not met, the routine proceeds to 504 where engine operation with the selected cylinders deactivated (skip-fire operation) is maintained. Else, if reactivation conditions are met, the routine proceeds to 506 where it is determined if the engine soot load is higher than a threshold. The soot load may be measured or inferred. For example, the soot load may be predicted based on the temperature of the cylinders slated for reactivation, the temperature based on a duration (e.g., number of engine cycles or number of combustion events) over which each given deactivated cylinder was operated without fuel and spark. In addition, the cylinder temperature and soot load may be predicted based on the total number of deactivated/active cylinders in the cylinder pattern applied during the deactivation. For example as the total number of deactivated/active cylinders in the cylinder pattern increases, the predicted soot load may increase due to increased cylinder cooling. Likewise, as the duration over which a deactivated cylinder is operated without fuel and spark increases, the predicted soot load may increase due to increased cylinder cooling. The soot load may be further based on a parameter indicative of engine soot load, such as engine coolant temperature. For example, at lower engine coolant temperature conditions, reactivated engine cylinders may be more prone to soot production that at higher engine coolant temperature conditions.

In some embodiments, in response to reactivation conditions being met, a second counter of a deactivated cylinder may be reset. The second counter may be configured to keep track of a number of combustion events, intake events, exhaust events, or similar events for the cylinder that was deactivated after the cylinder is reactivated. The value in the cylinder's second counter is updated each time a combustion event or other specified event occurs after the cylinder is reactivated. Routine 500 increments the values stored in the second counter of each deactivated cylinder that is reactivated in this way. The routine proceeds to 506 after the second cylinder counters are reset.

If the (estimated or predicted) soot load is not higher than the threshold, then at 508, the routine includes resuming cylinder operation in the previously deactivated cylinders. Specifically, fuel and spark may be resumed in addition to resuming intake and exhaust valve operation in the reactivated cylinders. The engine cylinders are reactivated by allowing the intake and exhaust valves of the cylinders to open and close during cycles of the cylinders. The routine further includes injecting fuel as a single fuel injection per engine cycle to the reactivated cylinders while also injecting fuel as a single fuel injection per engine cycle to remaining active cylinders for a first duration d1. At 510, the routine further includes retarding a start of fuel injection (SOI) timing of the reactivated cylinders by a first, smaller amount for the first duration d1 while maintaining the SOI timing of the remaining active cylinders at the timing that was applied prior to the cylinder reactivation.

The amount of SOI timing retard applied to the reactivated cylinders as well as the first duration d1 over which it is applied may be based on the output of the first counter for the corresponding reactivated cylinder. For example, the controller may, at 508, for each reactivated cylinder, retrieve the output of the corresponding first counter and adjust the amount of SOI timing retard and duration d1 in accordance. Specifically, as the output of the first counter increases, one or more of the first duration d1 and the amount of SOI timing retard applied at the time of cylinder reactivation may be increased.

In addition, while resuming cylinder combustion in the previously deactivated cylinders, an output of the second counter may be incremented. For example, each time a combustion event (including a cylinder valve event, fuel event, and spark event) is completed in the reactivated cylinder, the second counter of the given reactivated cylinder may be incremented. This may be continued until a threshold number of counts is reached in the cylinder at which time nominal SOI timing may be resumed in the cylinder. In an alternate example, while resuming cylinder combustion in the previously deactivated cylinders, an output of the first counter may be decremented, the first counter decremented at a different rate (e.g., faster) than the rate at which the counter was incremented during the cylinder deactivation. When the output of the first counter returns to 0 (or an alternate baseline value), the nominal SOI timing in the reactivated cylinders may be resumed. In particular, after the counters have reached the desired value, all engine cylinders may be operated with single fuel injection and nominal fuel injection timing.

If the (estimated or predicted) soot load is higher than the threshold, then at 512, the routine includes resuming cylinder operation in the previously deactivated cylinders. Specifically, fuel and spark may be resumed in addition to resuming intake and exhaust valve operation in the reactivated cylinders. The engine cylinders are reactivated by allowing the intake and exhaust valves of the cylinders to open and close during cycles of the cylinders. The routine further includes injecting fuel as multiple fuel injections per engine cycle to the reactivated cylinders while continuing to inject fuel as a single fuel injection per engine cycle to remaining active cylinders for a second, different duration d2. At 514, the routine further includes retarding a start of fuel injection (SOI) timing of the reactivated cylinders by a second, larger amount for the second duration d2 while maintaining the SOI timing of the remaining active cylinders at the timing that was applied prior to the cylinder reactivation.

The number of injections in the multiple fuel injection per engine cycle, the amount of SOI timing retard applied to the reactivated cylinders as well as the second duration d2 over which it is applied may be based on the output of the first counter for the corresponding reactivated cylinders. For example, the controller may, at 512, for each reactivated cylinder, retrieve the output of the corresponding first counter and adjust the number of fuel injections per engine cycle, the amount of SOI timing retard and duration d2 in accordance. Specifically, as the output of the first counter increases, each of the number of fuel injections per engine cycle, the second duration d2 and the amount of SOI timing retard applied at the time of cylinder reactivation may be increased. At the same time, the duration of each of the multiple fuel injections may be decreased resulting in multiple shorter fuel injections. In one example, the reactivated cylinders may receive multiple compression stroke fuel injections while the remaining active cylinders continue to receive a single intake stroke fuel injection (or multiple intake stroke injections).

In addition, while resuming cylinder combustion in the previously deactivated cylinders, an output of the second counter may be incremented. For example, each time a combustion event (including a cylinder valve event, fuel event, and spark event) is completed in the reactivated cylinder, the second counter of the given reactivated cylinder may be incremented. This may be continued until a threshold number of counts is reached in the cylinder at which time nominal SOI timing and single fuel injection may be resumed in the reactivated cylinder. In still another example, the number of injections in the multiple injections per engine cycle may be adjusted as the second counter is incremented towards the threshold number of counts. Therein, the number of injections in the multiple injections per engine cycle may be decreased and the amount of injection timing retard may be decreased as the second counter is incremented towards the threshold number of counts, and after the threshold number of counts is reached, single injections per engine cycle at nominal timing may be resumed in the reactivated cylinder.

In some examples, the remaining active cylinders (that is, the cylinders that were active both before and after the reactivation and were not deactivated during the deactivation) may also be operated with split fuel injection after the deactivated cylinders are reactivated. However, the number of fuel injections per engine cycle and the amount of SOI timing retard applied to them may be lower than the number of fuel injections per engine cycle and the amount of SOI timing retard applied to the reactivated engine cylinders.

In an alternate example, while resuming cylinder combustion in the previously deactivated cylinders, an output of the first counter may be decremented, the first counter decremented at a different rate (e.g., faster) than the rate at which the counter was incremented during the cylinder deactivation. When the output of the first counter returns to 0 (or an alternate baseline value), the nominal SOI timing and single fuel injection may be resumed in the reactivated cylinders. In particular, after the counters have reached the desired value, all engine cylinders may be operated with single fuel injection and nominal fuel injection timing.

In one example, when the cylinders are reactivated and the engine coolant temperature is sufficiently high, the PM load is lower, and/or warm cylinder conditions are present, fuel may be delivered to the reactivated cylinders as a single fuel injection that starts at 50 CAD ATDC in the intake stroke and lasts 40 CAD. In comparison, when the cylinders are reactivated and the engine coolant temperature is low, the PM load is higher, and/or cold cylinder conditions are present, fuel injection delivery may be retarded to 80 ATDC. As another example, fuel delivery may be split into two intake injections at or around 70 ATDC and 100 ATDC with durations of 20 CAD each (that is, more frequent shorter injections). In still further examples, more than 2 injections may be used for even colder cylinders, depending on the capabilities of the cylinder direct injectors.

By applying later injection timings and multiple shorter injections (e.g., direct injections) to the reactivated engine cylinder during conditions when coolant temperature is lower or soot load is higher, the likelihood of fuel reaching the cooler combustion chamber surface is reduced. As a result, PM emissions from a reactivated cylinder that has cooled due to prior cylinder deactivation may be reduced.

In one example, empirically determined SOI timing for a reactivated cylinder may be stored in a table or function that is indexed via a value in the second counter of the cylinder receiving the fuel. The value in the second counter corresponds to a number of combustion events or other events in the cylinder receiving the fuel since the cylinder receiving the fuel was reactivated. In one example, SOI timing for reactivated cylinder begins retarded from SOI timing of cylinders that were active while the reactivated cylinder was deactivated and SOI timing is advanced as the number in counter number two of the cylinder receiving the fuel increases. Additionally, in some examples, SOI timing of cylinders that were active when the reactivated cylinders were deactivated is adjusting to a same SOI timing as cylinders that were reactivated. Further, in some examples, the second counter may be omitted and cylinders being reactivated and cylinders that remained active while other cylinders where deactivated may be supplied fuel with an increased actual total number of fuel injections and retarded SOI timing as compared to operating at the same engine speed and load without having transitions from a cylinder deactivation mode to all cylinders operating within a predetermined amount of time (e.g., a time for the fuel injection timing to stabilize at a constant timing).

It will be further appreciated that routine 500 adjusts the actual total number of fuel injections based on an actual number of combustion events in the actual cylinder because a number of combustion events may provide improved cylinder status conditions as a basis for adjusting SOI and actual number of injections for reactivated cylinders. For example, a total number of combustion events may be a better indicator of cylinder conditions than time based estimates of cylinder temperature and cylinder contents (e.g., air and exhaust gas) because discrete engine events may be directly related to engine conditions, whereas time based parameters may be more loosely related to engine conditions. However, in still further examples, a piston/combustion chamber temperature model may be used to track when the reactivated cylinders need the most fuel injection adjustment/correction to compensate for potential PM emissions from cooled surfaces.

For example, the amount of retard and number of split injections applied to the reactivated cylinders may be adjusted based on the expected temperature of the reactivated cylinder when it is fired at a time of reactivation. Piston temperature is a likely metric to track, although fuel temperature or cylinder liner temperature may also be considered. In one example, if the piston temperature in the reactivated cylinder is over 120° C., normal injection timing and single fuel injection is used. As the piston temperature in the reactivated cylinder decreases to 90° C., injection timing may be gradually retarded. As the piston temperature in the reactivated cylinder further decreases from 90° C. to 60° C., the fuel injection may be split into two, retarded injections of shorter durations per engine cycle. As the piston temperature of the reactivated cylinder falls below 60° C., fuel injection may be split into three, retarded injections of even shorter durations per engine cycle. As such, the location of the temperature break points and the maximum number of split injections may vary based on engine operating conditions as well as engine configuration (e.g., based on whether the engine is an in-line 4 cylinder engine or an in-line 6 cylinder engine or a V-engine with 8 cylinders).

It will be further appreciated that the multiple fuel injections delivered to the reactivated cylinders may be further adjusted based on an alcohol content of the injected fuel. For example, the adjustment may be based on the ethanol content of direct injected fuel delivered to the reactivated cylinders. Fuels with a large fraction of alcohol tend to make less soot. As one example, for a given cylinder being reactivated, the number of multiple injections may be decreased as the alcohol content of the fuel delivered to the cylinder during the reactivation increases.

In this way, the actual number of fuel injections delivered to a cylinder that was reactivated may be adjusted based on the number of combustion events in the cylinder since it was reactivated. Further, in some examples, an actual number of fuel injections for cylinders that remained active while other cylinders were deactivated may be made the same as cylinders that were deactivated. The actual total number of fuel injections supplied to a reactivated cylinder may be greater than an actual total number of fuel injections supplied to an active cylinder when the reactivated cylinders were deactivated.

The actual total number of fuel injections delivered to a reactivated cylinder based on a number of combustion events in the reactivated cylinder may be empirically determined and stored in a table or function that is indexed by the value in the second counter of the cylinder receiving the fuel injection. The table outputs the actual total number of fuel injections and fuel is injected to the cylinder to conform to table output.

Once single fuel injection is resumed in the reactivated cylinders, the value of each second counter for each reactivated cylinder is reset to zero. Thereafter all active engine cylinders are operated with a same SOI timing and number of fuel injections per cylinder cycle. However, a fuel amount supplied to a particular cylinder may vary from fuel amounts supplied to other engine cylinders.

In one example, fuel injection timing of newly reactivated cylinder or cylinders that are being reactivated is adjusted to a start of injection timing (SOI) that is retarded from start of injection timing in the cylinders that remained activated. Specifically, if (SOI) timing for cylinders that remained activated was the same for all cylinders that remained activated and the SOI fuel injection timing was 50 ATDC in the cylinder receiving the injected fuel, then SOI timing for cylinders that were deactivated may be retarded to 120 ATDC for a first combustion event since the cylinder receiving the fuel was reactivated.

In some examples, the SOI timing for cylinders that were deactivated is based on a number of engine cycles or cylinder cycles of the cylinder receiving the injected fuel was deactivated. For example, if the cylinder being reactivated was deactivated for two cylinder cycles, SOI timing may be 50 ATDC in the cylinder receiving the injected fuel. However, if the cylinder being reactivated was deactivated two hundred cylinder cycles, the SOI timing may be 120 ATDC in the cylinder receiving the fuel.

By adjusting SOI timing for cylinders being reactivated and active cylinder based on a number of cylinder cycles or engine cycles a cylinder was deactivated, it may be possible to adjust SOI timing to reduce particulate emissions more repeatable than if SOI were simply adjusted based on an amount of time a cylinder was deactivated. Adjusting SOI timing based on number of engine or cylinder cycles may be more reflective of cylinder contents (e.g. exhaust and air) than time because an actual total number of cylinder or engine cycles is invariant whereas a number of engine or cylinder cycles may vary for a fixed duration of time because of engine speed variations. Fuel injected to other engine cylinders being reactivated is supplied in a similar manner.

In addition to adjusting SOI timing of cylinders being reactivated, an actual total number of fuel injections supplied to cylinders being reactivated may be adjusted. In one example, a number of fuel injections supplied to a cylinder receiving the injected fuel for a first combustion event in the cylinder receiving the fuel since the cylinder was reactivated from a deactivated state is based on an actual total number of engine cycles or cylinder cycles the cylinder receiving the fuel was deactivated. For example, if a cylinder was deactivated for two cylinder cycles, the cylinder may be supplied a total of one fuel pulse for a first combustion event in the cylinder receiving the fuel since the cylinder receiving the fuel was deactivated. However, if the same cylinder was deactivated for two hundred cylinder cycles, the cylinder may be supplied a total of two fuel pulses for a first combustion event in the cylinder receiving the fuel since the cylinder receiving the fuel was deactivated. Fuel injected to other engine cylinders being reactivated is supplied in a similar manner. An actual number of fuel injections supplied to cylinders that remained activated is not changed responsive to a number of combustion events since cylinders were reactivated.

In this way, fuel injection for reactivated cylinders may be adjusted to control particulate emissions and improve fuel economy without the need for additional hardware.

In one example, when engine coolant temperature is lower, a controller may deactivate a first cylinder pattern of individual cylinder valve mechanisms, and inject fuel as multiple injections per engine cycle when the first cylinder pattern is reactivated. In comparison, when engine coolant temperature is higher, the controller may deactivate a second, different cylinder pattern of individual cylinder valve mechanisms, and inject fuel as a single fuel injection per engine cycle when the second cylinder pattern is reactivated. The first pattern may be based on each of driver demand and engine soot load while the second pattern is based on driver demand and not on engine soot load, each of the first and second patterns further based on one or more of engine speed, vehicle speed, and transmission gear selection. The first pattern may include a first total number of deactivated/active cylinders, a first set of deactivated cylinders, and a first set of cylinder deactivation mechanisms while the second pattern includes a second, different total number of deactivated/active cylinders, a second, different set of deactivated cylinders, and a second, different set of cylinder deactivation mechanisms. A number of injections in the multiple injections per engine cycle to a reactivated cylinder may be based on the first total number of deactivated/active cylinders of the first pattern, and further based on a number of deactivation cycles of the reactivated cylinder, the number of injections increased as the first total number of deactivated/active cylinders of the first pattern increases and as the number of deactivation cycles of the reactivated cylinder increases.

Further, when the first cylinder pattern is reactivated, the controller may operate reactivated cylinders with more fuel injection timing retard while injecting fuel as multiple injections per engine cycle. Then, when the second cylinder pattern is reactivated, the controller may operate reactivated cylinders with less fuel injection timing retard while injecting fuel as a single injection per engine cycle. Further, when the first cylinder pattern is reactivated, after operating the reactivated cylinders with multiple injections per engine cycle for a number of combustion events, the controller may gradually decrease the number of injections per engine cycle to a single injection per engine cycle.

Figure 6:
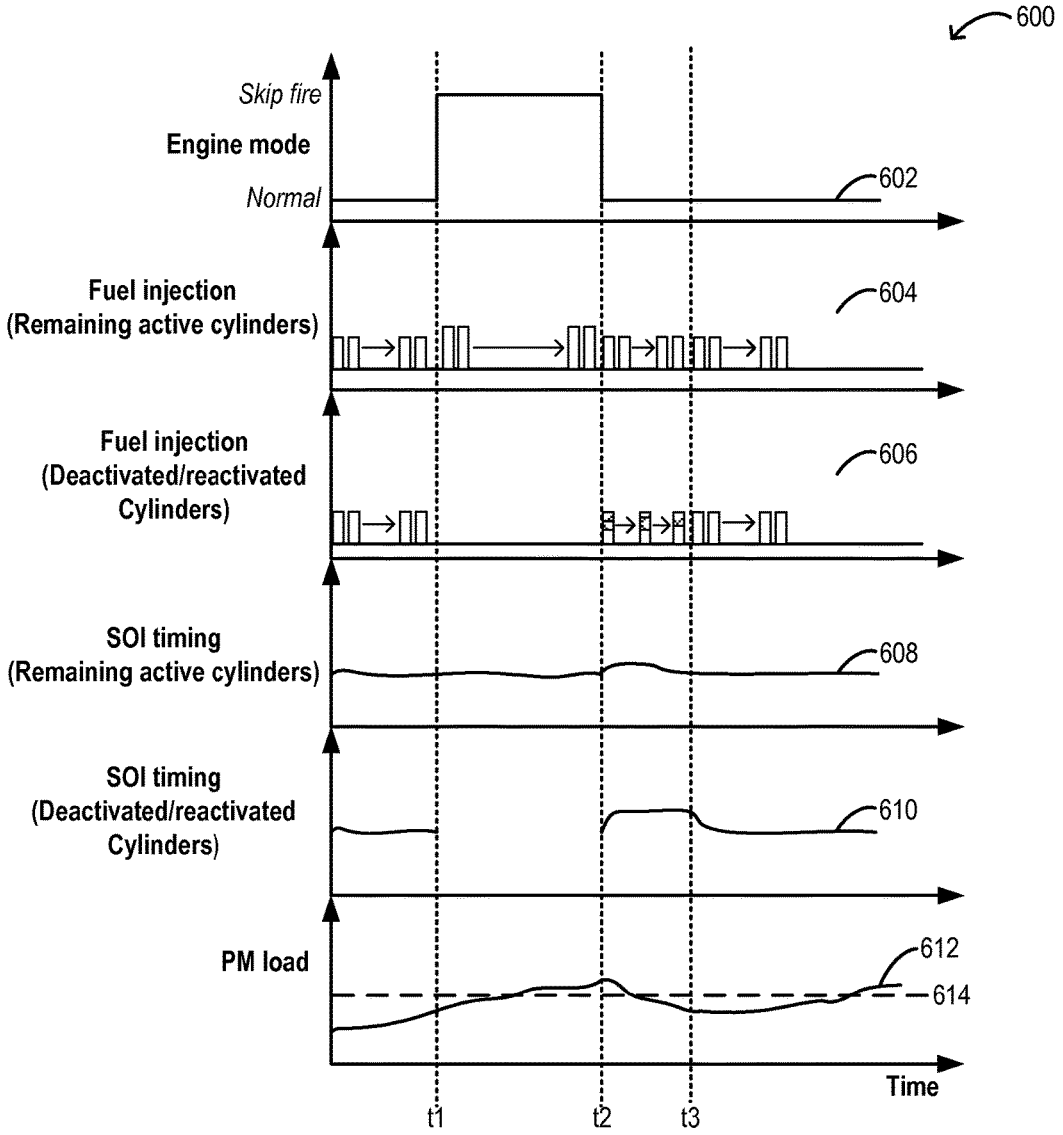
FIG. 6 shows an example fuel injection adjustment during a transition out of a skip-fire mode of operation.

Now turning to FIG. 6, map 600 depicts an example fuel injection adjustment for engine cylinders during cylinder deactivation and subsequent cylinder reactivation. The adjustment is performed responsive to an estimated rise in particulate matter emissions from cooled cylinders to allow cylinder deactivation to be prolonged and exhaust PM emissions to be reduced. Map 600 depicts cylinder mode of operation (deactivated or active) at plot 602, fuel injection amount of deactivated/reactivated cylinders at plot 604 and of remaining active cylinders at plot 606, fuel start of injection (SOI) timing of deactivated/reactivated cylinders at plot 608 and of remaining engine cylinders at plot 610, and engine PM load at plot 612.

Prior to t1, the engine may be operating with all cylinders firing and active. During this mode, all cylinders may be receiving fuel as a single intake stroke injection (depicted by single solid bar). At t1, in response to a change in operating conditions (e.g., a drop in engine load or torque demand), the engine may shift to a mode of operation where one or more cylinders (herein also referred to as the skipped fire cylinders) are selectively deactivated by shutting of fuel and spark while also closing intake and exhaust valve operation of the deactivated cylinders. A number and identity of deactivated cylinders may be selected to provide a specific cylinder pattern. At the same time, remaining active cylinders continue to receive fuel and spark while their intake and exhaust valves open and close during engine cycles. As such, due to the selective cylinder deactivation, the cylinder load of the active cylinders may increase. As shown, the active cylinders may continue single intake stroke injection with a relatively larger amount of total fuel injected (relative to before t1) corresponding to the higher cylinder load. For the deactivated cylinders, there will be no airflow through the deactivated valves, but the cylinder piston and combustion surface will cool since no combusted air and fuel mixture is heating the cylinder.

Between t1 and t2, as engine operation with selective cylinder deactivation continues, there may be a rise in engine soot load such that shortly before t2, the soot load is at or above a threshold load 614. As such, above this threshold load, a further rise in PM load, as may be expected when the deactivated cylinders are subsequently reactivated (due to cylinder cooling during the deactivation), may lead to degraded exhaust emissions. In addition, a fuel penalty may be incurred during the cylinder reactivation because of the extra heat that needs to be generated to heat the cylinder combustion surfaces.

At t2, cylinder reactivation conditions may be met, for example, in response to an increase in driver torque demand. To reduce the fuel penalty incurred during cylinder reactivation without degrading exhaust emissions, at t2, fuel injection of the reactivated cylinders may be shifted to a split fuel injection while maintaining the remaining active cylinders operating with single fuel injection. Specifically, the total amount of fuel may be initially (closer to t2) delivered as a first intake stroke injection (depicted by solid bar), a second intake stroke injection (depicted by cross hatched bar), and a third compression stroke injection (depicted by diagonal hatched bar). The split fuel injection may be maintained for a duration (defined by a number of combustion cycles) between t2 and t3, with the total amount of fuel gradually transitioned to a first intake stroke injection (solid bar), and a second compression or intake stroke injection (cross hatched bar) by t3, before single intake stroke fuel injection is resumed after t3. A start of the split fuel injection timing may also be retarded from a nominal timing. The number of engine cycles where split fuel injection is applied, the ratio of the injections in each engine cycles, as well as the retard applied to the SOI timing of each fuel injection may be based on a difference between the PM and the threshold, the cylinder pattern applied during the previous deactivation, as well as a number of engine cycles over which the deactivated cylinders were held inactive. The number of engine cycles where split fuel injection is applied may be further adjusted based on a number of actual combustion events that have occurred in the reactivated cylinder since the reactivation. For example, in response to a threshold number of combustion events having occurred in the reactivated cylinders since the reactivation at t2, single fuel injection is resumed at t3. In the depicted example, the split ratio is adjusted to include a higher amount of the first intake stroke injection and a lower amount of the second (and third) compression stroke injection(s). The split fuel injection, and the retarded start of injection timing in the reactivated cylinders has the technical effect of raising cylinder temperature sufficiently so that the combustion surface can be warmed and PM emissions from fuel residue on cold combustion surfaces is reduced.

It will be appreciated that while the depicted example suggests deactivated cylinders being inactive for a same number of engine cycles, and reactivated cylinders receiving split fuel injections for a same number of combustion events since the reactivation, in alternate examples, the numbers may differ between cylinders. Specifically, based on the cylinder pattern applied during the selective deactivation, including the identity and number of total deactivated/active cylinders, and further based on the firing order of the cylinders, over a duration, each deactivated cylinder may have been skipped for a different number of engine cycles. Accordingly, the split fuel injection and injection timing retard to each reactivated cylinder may be adjusted differently.

As an example, in an in-line 4 cylinder engine, where the firing order is 1342, cylinders 2 and 3 may have been selected for deactivation. The engine may be deactivated for 6 engine cycles just prior to the firing of cylinder 4. The engine may be reactivated shortly after the $6^{th}$ firing of cylinder 4 but before the firing of cylinder 1 in the cylinder pattern $4x_21x_34x_21x_34x_21x_34x_21x_34x_21x_34x_2$, where $x_2$ represents the skipping of cylinder 2 and $x_3$ represents the skipping of cylinder 3. As can be seen from the pattern, in the given duration, active cylinder 4 has fired six times, active cylinder 1 has fired five times, and inactive cylinder 2 has been skipped six times, while inactive cylinder 3 has been skipped five times. Consequently, at the time of cylinder reactivation, active cylinder 4 may be warmer than active cylinder 1 due to a larger number of firings over the period of deactivation, while inactive cylinder 2 may be cooler than inactive cylinder due to a larger number of skipped firings over the period of deactivation. Therefore, during the reactivation, cylinder 2 may be operated with split fuel injection having a larger number of injections per cycle relative to cylinder 3, operated with a larger amount of SOI timing retard relative to cylinder 3, operated with split fuel injection over a larger number of engine cycles since cylinder 2 is reactivated relative to cylinder 3 or any combination thereof. Likewise, during the reactivation, active cylinder 1 may be operated with a larger number of injections per cycle relative to cylinder 4, operated with a larger amount of SOI timing retard relative to cylinder 4, operated with split fuel injection over a larger number of engine cycles since cylinders 2 and 3 are reactivated relative to cylinder 4 or any combination thereof.

The use of split fuel injection alongside injection timing retard in the reactivated cylinders is continued for a number of combustion events between t2 and t3 until the cylinder temperature is sufficiently warm and the PM load is reduced below threshold 612. At t3, once the cylinder has been sufficiently warmed, single intake stroke fuel injection in the reactivated cylinders is resumed while injection timing is returned to nominal values. As such, while the reactivated cylinders are operated with multiple fuel injections per cycle and retarded start of injection timing, the remaining active cylinders (that is, the cylinders that remained active during the previous cylinder deactivation and the subsequent reactivation) may continue to be operated with single fuel injection per cycle and nominal start of injection timing. In alternate examples, the active cylinders may also be operated with multiple fuel injections per engine cycle and retarded start of injection timing, however, the number of injections and the amount of injection timing retard applied to the active cylinders may be lower than those applied to the reactivated cylinders at the same time.

As such, if the reactivated cylinders were not shifted transiently to a retarded split fuel injection mode, a larger amount of fuel and spark retard may have been needed to warm the reactivated cylinders, lowering fuel economy and potentially degrading exhaust PM emissions. By also adjusting the cylinder pattern of active cylinders when selected cylinders are deactivated (at t1), engine operation with deactivated cylinders can be prolonged and fuel economy benefits can be extended for a longer duration of engine operation.

It will be appreciated that if the PM load was below threshold 614 at the time of cylinder reactivation (t2), the reactivated cylinders as well as the remaining active engine cylinders may have been operated with single intake stroke injection only. In addition, the SOI timing may not have been retarded since additional cylinder heating may not have been required. Alternatively, the reactivated cylinders may have been operated with multiple fuel injection but with a smaller number of injections per engine cycle and less SOI timing retard as compared to cylinder reactivation at higher PM load. In addition, the split retarded fuel injections may have been maintained for a shorter duration (as compared to the duration t2-t3) before resuming single intake stroke injection in the reactivated cylinders. In this way, the PM load of the engine is reduced during cylinder reactivation.

As an example, an engine system, comprises an engine including a plurality of cylinders; electrically actuated cylinder valve mechanisms coupled to each of the plurality of cylinders; a selectively deactivatable fuel injector coupled to each of the plurality of cylinders; and an engine controller. The controller may be configured with computer readable instructions stored on non-transitory memory for: deactivating individual cylinder valve mechanisms for one or more of the plurality of cylinders according to a pattern, a total number of deactivated/active cylinders and an order of firing of active cylinders in the pattern adjusted to maintain a temperature of each engine cylinder above a threshold temperature, the threshold temperature based on a soot load of the engine. During the deactivating, a number and pattern of cylinder valve mechanisms operating per active cylinder is also based on the soot load of the engine. The controller may include further instructions for: during reactivation of the deactivated individual cylinder valve mechanisms, increasing each of a number of fuel injections per engine cycle and an amount of fuel injection timing retard in reactivated cylinders as the temperature of the reactivated cylinders falls below the threshold temperature at the reactivation; and after the temperature of the reactivated cylinders rises above the threshold temperature, resuming single fuel injection per engine cycle in the reactivated cylinders.

In further representations, the method for reducing particulate matter emissions includes, during reactivation of a cylinder after a skip-fire operation, when engine soot load is above a threshold, operating the cylinder with multiple fuel injections per cylinder cycle; and when engine soot load is below the threshold, operating the cylinder with single fuel injection per the cylinder cycle. In another representation, a method for skip-fire control of an engine comprises, when an amount of particulate matter is greater than a threshold, keeping only the cylinders with a cylinder block temperature greater than a threshold temperature active with multiple fuel injections in a cylinder cycle, and when the amount of particulate matter is less than the threshold, keeping all cylinders active with single fuel injection in a cylinder cycle.

In still another representation, the method includes, reactivating a cylinder pattern of total deactivated/active engine cylinders, and during the reactivation, responsive to engine coolant temperature being lower than a threshold (or engine soot load being higher than a threshold), delivering fuel to reactivated engine cylinders as multiple fuel injections per engine cycle, each injection of the multiple fuel injections smaller and retarded as compared to corresponding fuel injections in active engine cylinders, a number of injections of the multiple fuel injections larger as compared to corresponding fuel injections in active engine cylinders. The delivering fuel may include delivering fuel as a first, intake stroke injection and a second, compression stroke injection to each reactivated cylinder while delivering fuel as a single, intake stroke injection to each active cylinder. Further, a start of injection timing of the single intake stroke injection to each active cylinder may be retarded relative to the first, intake stroke injection to each reactivated cylinder. Further still, an amount of fuel and pulse width of fuel injection of the single intake stroke injection to each active cylinder may be larger relative to the first, intake stroke injection to each reactivated cylinder.

In this way, the technical effect of adjusting the cylinder pattern of selective cylinder deactivation responsive to an actual or predicted particulate matter emission of an engine is that deactivation benefits can be achieved for a longer time without degrading exhaust emissions. By varying a total number of deactivated/active cylinders in the cylinder pattern, as well as the identity of the deactivated/active cylinders in the cylinder pattern, cylinder combustion surfaces can be maintained sufficiently warm over the duration of the cylinder deactivation. As such, this not only reduces the need for cool cylinder reactivation, thereby improving fuel economy, but also reduces the particulate matter emissions from the reactivated cylinders. By also operating the reactivated cylinders with split fuel injection with a portion of fuel delivered during an intake stroke and a portion of the fuel delivered during a compression stroke, PM emissions of the reactivated cylinders is further reduced. By optionally also operating active cylinders with split fuel injection for a number of combustion events while other cylinders of the cylinder pattern are deactivated, cylinder warming is expedited, and a duration of engine operation with cylinder deactivation is prolonged. This allows the fuel economy benefits of cylinder deactivation to be extended, improving engine performance and fuel economy.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

operating an engine in a first mode that includes cylinder deactivation conditions being met;

in response to operating the engine in the first mode, deactivating individual cylinder valve mechanisms according to a cylinder pattern selected based on engine coolant temperature, including when engine coolant temperature is lower than a threshold, deactivating individual cylinder valve mechanisms according to a first cylinder pattern, and, when engine coolant temperature is higher than the threshold, deactivating individual cylinder valve mechanisms according to a second, different cylinder pattern;

operating the engine in a second mode that includes cylinder reactivation conditions being met;

in response to operating the engine in the second mode, reactivating the deactivated individual cylinder valve mechanisms and injecting fuel to cylinders according to a fuel injection pattern selected based on engine coolant temperature, including injecting fuel as multiple injections per engine cycle to reactivated cylinders while injecting fuel as a single fuel injection per engine cycle to remaining active cylinders when engine coolant temperature is below the threshold, and injecting fuel as a single fuel injection per engine cycle to all cylinders when engine coolant temperature is above the threshold.

2. The method of claim 1, wherein the first cylinder pattern is further based on each of driver demand and engine soot load while the second cylinder pattern is further based on driver demand and not on engine soot load, each of the first and second cylinder patterns further based on one or more of engine speed, vehicle speed, and transmission gear selection.

3. The method of claim 1, wherein the first cylinder pattern includes a first total number of deactivated cylinders, a first set of deactivated cylinders, and a first set of cylinder deactivation mechanisms and wherein the second cylinder pattern includes a second, different total number of deactivated cylinders, a second, different set of deactivated cylinders, and a second, different set of cylinder deactivation mechanisms.

4. The method of claim 3, wherein a number of injections in the multiple injections per engine cycle to a reactivated cylinder is based on the first total number of deactivated cylinders of the first cylinder pattern, and further based on a number of deactivation cycles of the reactivated cylinder, the number of injections increased as the first total number of deactivated cylinders of the first cylinder pattern increases and as the number of deactivation cycles of the reactivated cylinder increases.

5. The method of claim 4, further comprising, when the individual cylinder valve mechanisms deactivated according to the first cylinder pattern are reactivated, operating reactivated cylinders with a first amount of fuel injection timing retard while injecting fuel as multiple injections per engine cycle, and, when the individual cylinder valve mechanisms deactivated according to the second cylinder pattern are reactivated, operating reactivated cylinders with a second, smaller amount of fuel injection timing retard while injecting fuel as a single injection per engine cycle.

6. The method of claim 5, further comprising, when the individual cylinder valve mechanisms deactivated according to the first cylinder pattern are reactivated, after operating the reactivated cylinders with multiple injections per engine cycle for a number of combustion events, gradually decreasing the number of injections per engine cycle to a single injection per engine cycle.

7. A method, comprising:

responsive to cylinder deactivation conditions being met and engine coolant temperature being lower than a threshold, deactivating a first set of cylinders of an engine according to a first cylinder deactivation pattern that includes a first number of deactivated cylinders and a first duration of deactivation; and injecting fuel as multiple injections per engine cycle when the first set of cylinders is reactivated, a number of injections in the multiple injections per engine cycle based on the first number of deactivated cylinders and further based on the first duration of deactivation, the number of injections increased as the first number of deactivated cylinders increases and as the first duration of deactivation increases;

responsive to cylinder deactivation conditions being met and engine coolant temperature being higher than the threshold, deactivating a second set of cylinders according to a second cylinder deactivation pattern that includes a second number of deactivated cylinders and a second duration of deactivation; and injecting fuel as a single injection per engine cycle when the second set of cylinders is reactivated.

8. The method of claim 7, wherein the first cylinder deactivation pattern is selected based on each of driver demand and engine soot load while the second cylinder deactivation pattern is selected based on driver demand and not on engine soot load, each of the first and second cylinder deactivation patterns further based on one or more of engine speed, vehicle speed, and transmission gear selection.

9. The method of claim 7, further comprising, when the first set of cylinders is reactivated, operating the first set of cylinders with a first amount of fuel injection timing retard while injecting fuel as multiple injections per engine cycle, and, when the second set of cylinders is reactivated, operating the second set of cylinders with a second amount of fuel injection timing retard while injecting fuel as a single injection per engine cycle.

10. The method of claim 9, further comprising, when the first set of cylinders is reactivated, operating the first set of cylinders with multiple injections per engine cycle for a number of combustion events, and gradually decreasing the number of injections per engine cycle to a single injection per engine cycle.

* * * * *